United States Patent [19]

Benham

[11] 4,415,183

[45] Nov. 15, 1983

[54] MULTI-POCKET PAD RETAINING FOLDER AND BLANK THEREFOR

[75] Inventor: Albert A. Benham, Granville, Mass.

[73] Assignee: Champion International Corporation, Stamford, Conn.

[21] Appl. No.: 311,798

[22] Filed: Oct. 15, 1981

[51] Int. Cl.[3] ..... B42D 3/12; B65D 27/08; A45C 11/34

[52] U.S. Cl. ..... 281/31; 150/39; 229/72; 493/920

[58] Field of Search ..... 281/29, 31, 1, 3, 4, 281/16, 17, 19; 493/920, 918; 229/72; 150/39

[56] References Cited

U.S. PATENT DOCUMENTS

| | | | |
|---|---|---|---|
| 528,420 | 10/1894 | Estlow | 150/39 |
| 528,421 | 10/1894 | Estlow | 150/39 |
| 2,710,716 | 6/1955 | Deutschmeister et al. | 229/72 X |
| 2,799,391 | 7/1957 | Eisner | 281/31 X |
| 2,965,282 | 12/1960 | Whitman | 229/72 |
| 4,157,875 | 6/1979 | Smith et al. | D19/26 |
| 4,313,558 | 2/1982 | Benham | 229/72 |
| 4,331,290 | 5/1982 | Benham | 229/72 |

*Primary Examiner*—E. R. Kazenske
*Assistant Examiner*—John S. Brown
*Attorney, Agent, or Firm*—Evelyn M. Sommer

[57] ABSTRACT

A multi-pocket pad (folder) is formed from a one-piece paperboard blank. The folder includes a cover panel, two body panels and two pad retention panels which are adhered in a face-to-face relationship. Flap members, connected by fold lines on the opposite ends of the body panels, form a plurality of pockets. A retention panel has a structure, such as a slit or holes, to hold a notebook. An elongated panel (spline) may be used to hold a pen and the cover panel may be removably joined to a pad retention panel to close the folder.

9 Claims, 5 Drawing Figures

MULTI-POCKET PAD RETAINING FOLDER AND BLANK THEREFOR

BACKGROUND OF THE INVENTION

One of the most popular ways of keeping notes, reminders and lists is to enter them into a small notebook or writing pad. A typical notebook, for example, may be three by five inches in size and have a spiral holding the pages and covers together or may be a writing pad having blank pages and/or a cardboard back. However, frequently, when one has an idea or note to jot down and has the notebook, one does not have a pencil or pen. In addition, even if one has the notebook and a pen, they may be separated and mixed with other things, for example, in a book bag, purse or attache case. By the time the pen and notebook are found, the idea may be lost.

There are presently available a number of folders which have a pocket to contain a notebook and may have pockets for loose notes. Such folders generally are formed of plastic sheet materials. Although they do not protect notebooks placed in them, such plastic sheet folders may be relatively expensive cmpared to the price of the notebook itself. If a number of such folders are to be purchased, for example, for use by the members of a large family, or to be given away as a promotion device, the cost element may enter into consideration.

OBJECTIVES AND FEATURES OF THE INVENTION

It is an objective of the present invention to provide an expandable folder, i.e., a multi-pocket pad having a plurality of pockets, and means to hold a notebook.

It is a further objective of the present invention to provide such a folder which is constructed from coated paperboard, instead of plastic sheet material, so that it may be relatively inexpensive.

It is a further objective of the present invention to provide such a folder which is made from a single die-cut blank of coated paperboard, so that it may be made using conventional paperboard cutting and gluing technology and utilize existing paperboard cutting, production finishing and gluing machines.

It is a further objective of the present invention to provide such a folder which is convenient to use and sufficiently sturdy and water resistant so that it may be used by school children.

It is a further objective of the present invention to provide such a folder which provides a space for a writing instrument, such as a pen or pencil, so that the writing instrument is handy when the notebook is to be used.

It is a feature of the present invention to provide a one-piece paperboard blank which may be erected and glued to form a multi-pocket pad (folder). The blank comprises a series of substantially rectangular panels which lie in tandem along an imaginary central axis. The panels are a cover panel, a first body panel connected by a fold panel to the cover panel, a second body panel, a first pad retention panel and a second pad retention panel connected by a fold line to the first pad retention panel. The second pad retention panel has means to retain a notebook; such means may be a slit or a series of holes.

The blank further includes a plurality of flap members which, when adhered, form the multi-pockets. Two of the flap members are connected by fold lines, parallel to the central axis, at opposite ends of each of the body panels. Glue means is used to adhere portions of the inside faces of the two pad retention panels to each other and glue means is also used to adhere portions of the flap members to form the plurality of pockets.

It is a further feature of the present invention to provide a multi-pocket folder formed from a one-piece paperboard blank and having means to retain a notebook. The folder comprises a series of substantially rectangular panels consisting of a cover panel, a first body panel connected to the cover panel, a second body panel, a first pad retention panel and a second pad retention panel connected by a fold line to the first pad retention panel and having means, for example, a slit or a series of holes, to retain the notebook.

The folder also includes a plurality of flap members which are adhered to form the multi-pockets, two of the flap members being connected by fold lines at opposite ends of each of the body panels. Glue means adhere portions of the inside faces of the two pad retention panels to each other and glue means also adhere portions of the flap members to form the plurality of pockets.

DETAILED DESCRIPTION OF THE DRAWINGS

Other objectives and features of the present invention will be apparent from the following detailed description which provides the inventor's best mode of practicing the invention. The detailed description should be taken in conjunction with the accompanying drawings, in which.

Figure 1:
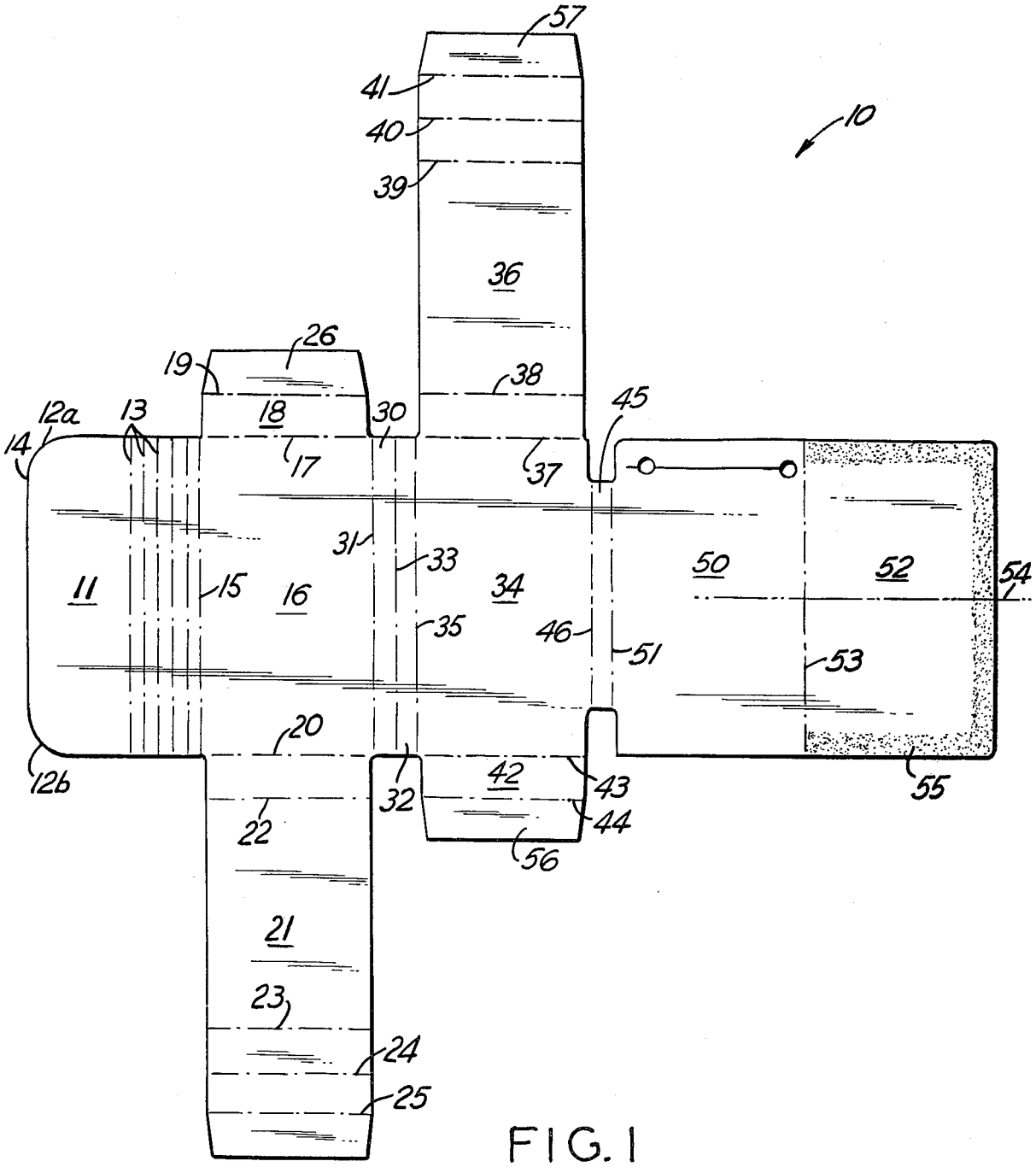
FIG. 1 is a top plan view showing the one-piece paperboard blank from which the multi-pocket pad (folder) of the present invention is formed.
Figure 2:
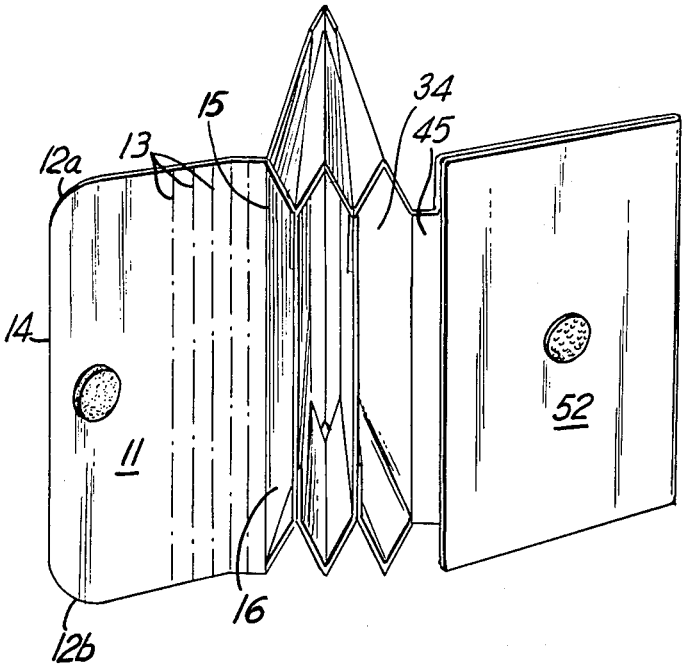
FIG. 2 is a front perspective view showing the multi-pocket pad of FIG. 1 after it has been assembled and showing the multi-pocket pad in its open position with its plurality of pockets.
Figure 3:
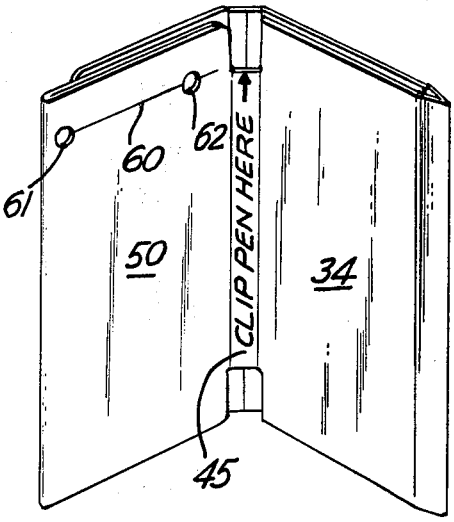
FIG. 3 is a perspective view of the multi-pocket pad of FIG. 2 showing the panel into which a portion of a memo pad may be inserted.
Figure 4:
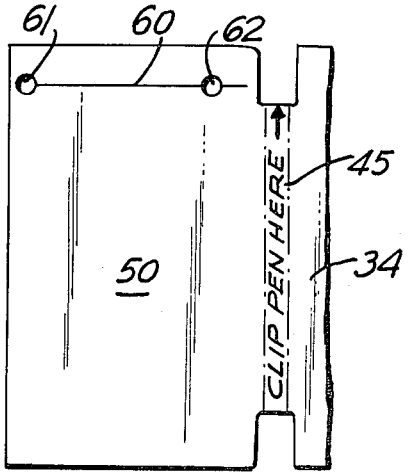
Figure 5:
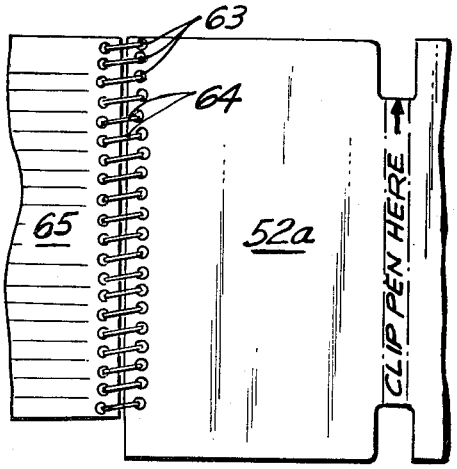

FIG. 4 is a top plan view of one of the panels of the multi-pocket pad showing the first embodiment of the present invention, also shown in FIGS. 1–3, in which the back cardboard of a memo pad is inserted through a slit; and FIG. 5 is a top plan view of a panel of the multi-pocket panel of the multi-pocket pad, showing an alternative embodiment, in which the spiral of a memo pad is inserted through holes along the edge of the panel.

DETAILED DESCRIPTION OF THE INVENTION

FIG. 1 illustrates the one-piece paperboard blank from which the multi-pocket pad of the present invention is formed. Preferably the paperboard is a coated cardboard. The one-piece blank of FIG. 1 may be die-cut, assembled and glued using conventional packaging machinery.

As shown in FIG. 1, the blank 10 includes a cover panel 11 having opposite free rounded edges **12*a* and 12*b*. A series of parallel fold lines 13 (indentations), preferably five in number, are parallel to the free edge 14 of the cover panel 11. These fold lines 13 are indentations in the outerside of the blank, i.e., the opposite side from the inside of the blank which is shown in FIG. 1**.

The cover panel 11 is joined, by a fold line 15, to a first body panel 16. The first body panel 16 is joined by a fold line 17 to a flap 18 which has a fold line 19 parallel to its fold line 17. The first body panel 16 is also joined by a fold line 20 to an elongated flap 21. The elongated flap 21 has four parallel fold lines 22 through 25. The distance between the fold line 20 and the fold line 24 is the same as the length of the panel 16, i.e., the distance between the fold lines 17 and 20. The panel 16 is joined to a first fold panel 30 by the fold line 31. The first fold panel 30 is joined to its congruent fold panel 32 by the fold line 33 with the fold panel 32 being joined to the second body panel 34 by the fold line 35.

The second body panel 34 has a similar set of flaps as the panel 16 but they are oppositely directed. Its elongated flap 36 is joined to the second body panel 34 by the fold line 37 and has four parallel fold lines 38 through 41. The short flap 42 is joined to the second body panel 34 by the fold line 43 and has a fold line 44 parallel thereto. The panel 34 is joined to an elongated fold panel 45 by the fold panel 46, with the fold panel 45 being joined to the first pad retention panel 50 by the fold line 51.

The first pad retention panel 50 is joined to the second pad retention panel 52 by the fold line 53. The panels are formed in tandem along an imaginary center line 54 with the panels 11, 16, 34, 50 and 52 being of the same height. Preferably the height of those panels 11, 16, 34, 50 and 52 is slightly larger than a conventional 5-inch-long pad. For example, the height is preferably $5\frac{1}{2}$ inches. The width of the pad retaining panels 50 and 52 is slightly greater than the width of a small memo pad, which may be, for example, $2\frac{3}{4}$ inches or $3\frac{1}{4}$ inches. Consequently, the width of the panels 50 and 52 is preferably about 3-5/16 inches.

The multi-pocket pad of the present invention, after it has been die-cut as shown in FIG. 1, is assembled and glued to form the final product. The glue is preferably applied by applying glue strips onto the blank of FIG. 1. A glue strip may be applied on the edges of the panel 52 on its inside face, i.e., around the perimeter of panel 52 except along the fold line 53, or onto the corresponding edges of panel 50. This glue strip 55 is used to adhere the inside face of the panel 52 to the inside face of the panel 50, the inside faces being the faces shown in FIG. 1.

The pockets are formed by adhering certain portions of the flap and panel members. The flaps 18,21,36,42 are folded inwardly (toward center line 54) along the respective fold lines 17,20,37 and 43. A glue strip on the outer portion 26 of the flap 18, at its outer face (not shown in FIG. 1) is adhered to a portion of the inner face of the flap 21 near to the fold line 23. Similarly, a glue strip on the outer portion 56 of the flap 42, at its outer face, adheres it to the outer face of the panel 16 near the fold line 22. A glue strip on the inner face of the portion 57 of the panel 36 adheres that portion 57 to the outer face of the panel 34 near the fold line 22. Similarly, a glue strip on the inner face of the flap 21, beyond the fold line 25, adheres that portion of the flap 21 to the outer face of the flap 36 near the fold line 38.

As shown in FIGS. 3 and 4, the panel 50 has a provision for the insertion of the cardboard backing sheet of a memo pad. A slit 60 extends almost entirely across the panel 50 and has two holes 61,62 near the opposite ends of the slit 60. The slit 60 is only in the panel 50 and does not extend through to the panel 52 to which it is joined. The slit 60 is below the glue line joining the panel 52 to the panel 50 and permits the center of the panel 50 to be lifted so that the cardboard backing sheet of a memo pad may be inserted through the slit 60. As shown in FIG. 4, the fold panel 45 has words stating, "Clip Pen Here", with an arrow to show that a pen may be clipped on the top edge of the fold panel 45.

The multi-pocket pad (folder) of the present invention may be closed by removably joining the panel 11 to the panel 52. As shown in FIG. 2, a preferred method of removably joining such panels is to use interlocking plastic disks, for example, of the type of interlocking plastic known as "Velcro" (trademark). One disk 27 is adhered to panel 11 and another disk 28 is adhered to panel 52, the disks being removably interlocked when their faces are pressed together.

In the alternative embodiment shown in FIG. 5, a series of holes are punched along the edge of the panel 50*a*, which panel 50*a* corresponds in position and size to the panel 52 of the prior embodiment. The holes 63 are through the panel 52*a* and the panel 52*b* (not shown), to which it is adhered, panel 52*b* corresponding the panel 52 of the prior embodiment. A spiral, for example, a plastic or metal wire 64, is inserted through the holes 63 and retains the notebook 65. The other portions of the multi-pocket pad of FIG. 5 are as shown in the prior embodiment of FIGS. 1–4.

What is claimed is:

1. A one-piece paperboard blank to be erected and glued to form a multi-pocket folder having means to retain a notebook, said blank comprising:

a series of substantially rectangular panels lying in tandem along an imaginary central axis and consisting of, aligned in order, a cover panel, a first body panel, a second body panel, a first pad retention panel and a second pad retention panel connected by a fold line to said first pad retention panel and having means to retain said notebook;

a plurality of flap members which, when adhered, form the multi-pockets, a pair of said flap members being connected by fold lines parallel to said central axis at opposite ends of each of said body panels, each pair of flap members comprising a short flap member having a second fold line parallel to its connecting fold line and a long flap member having four fold lines parallel to its said connecting fold line;

glue means to adhere portions of the inside faces of said two pad retention panels to each other; and glue means to adhere portions of said flap members to form a plurality of pockets.

2. A blank as in claim 1 wherein said glue means to adhere said pad retention panels is a glue strip along three edges of one of said pad retention panels.

3. A blank as in claim 1 and further including two narrow elongated fold panels connected to adjoining panels by fold lines, the first fold panel connected between said first and second body panels and the second fold panel connected between said second body panel and said first pad retention panel.

4. A blank as in claim 1 wherein, relative to said central axis, the said short flap member is at the top of the first body panel and the said long flap member is at the top of the second body panel.

5. A multi-pocket folder having means to retain a notebook formed from a one-piece paperboard blank, said folder comprising:

a series of substantially rectangular panels consisting of a cover panel, a first body panel, a second body panel, a first pad retention panel and a second pad retention panel connected by a fold line to said first pad retention panel and having means to retain said notebook;

a plurality of flap members which are adhered to form the multi-pockets, a pair of said flap members being connected by fold lines at opposite ends of each of said body panels, each pair of flap members comprising a long flap member having four fold lines parallel to its said connecting fold line and a short flap member;

glue means adhering portions of the inside faces of said two pad retention panels to each other; and glue means adhering portions of said flap members to form the said plurality of pockets.

6. A folder as in claim 5 wherein said glue means adhering said pad retention panels is a glue strip along three edges of one of said pad retention panels.

7. A folder as in claim 5 and further including two narrow elongated fold panels connected to adjoining panels by fold lines, the first fold panel connected between said first and second body panels and the second fold panel connected between said second body panel and said first pad retention panel.

8. A folder as in claim 5 wherein the said short flap member is at the top of the first body panel and the said long flap member is at the top of the second body panel.

9. A folder as in claim 5 wherein said cover panel, on its inside face, and said second pad retention panel each has removably interlocking means to removably secure said cover to said second pad retention panel.

* * * * *